US009999800B2

(12) United States Patent
Lin

(10) Patent No.: US 9,999,800 B2
(45) Date of Patent: Jun. 19, 2018

(54) MULTI-MODE SQUAT RACK

(71) Applicant: ASIA REGENT CORPORATION, Taichung (TW)

(72) Inventor: Yi-Hung Lin, Taichung (TW)

(73) Assignee: ASIA REGENT CORPORATION, Taichung (TW)

( * ) Notice: Subject to any disclaimer, the term of this patent is extended or adjusted under 35 U.S.C. 154(b) by 0 days. days.

(21) Appl. No.: 15/230,358

(22) Filed: Aug. 5, 2016

(65) Prior Publication Data

US 2018/0036589 A1 Feb. 8, 2018

(51) Int. Cl.

| | |
|---|---|
| ***A63B 21/02*** | (2006.01) |
| ***A63B 23/035*** | (2006.01) |
| ***A63B 21/04*** | (2006.01) |
| ***A63B 21/00*** | (2006.01) |
| ***A63B 23/04*** | (2006.01) |

(52) U.S. Cl.

CPC .... *A63B 23/03516* (2013.01); *A63B 21/0414* (2013.01); *A63B 21/151* (2013.01); *A63B 21/4031* (2015.10); *A63B 21/4034* (2015.10); *A63B 21/4035* (2015.10); *A63B 23/0405* (2013.01); *A63B 2023/0411* (2013.01)

(58) Field of Classification Search

CPC ..... A63B 23/03516; A63B 23/0405; A63B 21/4031; A63B 21/4034; A63B 21/151; A63B 21/0414; A63B 21/4035; A63B 2023/0411

USPC ..... 482/121–139

See application file for complete search history.

(56) References Cited

U.S. PATENT DOCUMENTS 2,455,548 A * 12/1948 Bell ..... A63B 21/068 482/96
5,100,131 A * 3/1992 Fong ..... A61H 1/0292 482/112
5,299,997 A * 4/1994 Chen ..... A63B 21/068 482/72
5,338,277 A * 8/1994 Yang ..... A63B 21/055 482/130
5,342,269 A * 8/1994 Huang ..... A63B 21/068 482/130
5,421,795 A * 6/1995 Chen ..... A63B 21/068 482/72
5,464,378 A * 11/1995 Yu ..... A63B 21/068 482/57
5,586,959 A * 12/1996 Adkins ..... A63B 21/068 482/72
5,616,106 A * 4/1997 Abelbeck ..... A63B 21/068 482/126

(Continued)

*Primary Examiner* — Garrett Atkinson

(57) ABSTRACT

A multi-mode squat rack includes a frame, a support unit and a handle unit. The frame includes two struts pivotally connected to each other, two stepping boards connected to one of the struts, and a mount pivotally connected to the first strut. The support unit includes a seat post pivotally connected to the first strut, a seat supported on the seat post, a pair of ears supported on a side of the seat post near the first strut, at least one fin supported on an opposite side of the seat post, and an elastic unit arranged between the mount and the fin. The handle unit includes a stem pivotally connected to the first strut, a connection rod formed with an end pivotally connected to the stem and another end pivotally connected to the first strut or the pair of ears, and a handle connected to the stem.

11 Claims, 17 Drawing Sheets

(56) References Cited

U.S. PATENT DOCUMENTS 5,618,250 A * 4/1997 Butz ..... A63B 21/0615 482/134
5,647,825 A * 7/1997 Adkins ..... A63B 21/068 482/114
5,833,590 A * 11/1998 Chiu ..... A63B 21/0552 482/112
5,931,769 A * 8/1999 Nunez ..... A61H 1/0292 482/121
6,022,303 A * 2/2000 Abdo ..... A63B 23/0211 482/121
6,135,930 A * 10/2000 Kuo ..... A63B 22/001 482/57
6,186,926 B1 * 2/2001 Ellis ..... A63B 21/0615 482/137
6,248,047 B1 * 6/2001 Abdo ..... A63B 21/023 482/121
6,544,151 B2 * 4/2003 Tornabene ..... A63B 21/055 482/122
6,602,171 B1 * 8/2003 Tsen ..... A63B 21/023 482/140
6,752,748 B1 * 6/2004 Scotti ..... A63B 21/0615 482/140
7,125,366 B1 * 10/2006 Yeh ..... A63B 21/055 482/122
7,229,389 B2 * 6/2007 Hong ..... A63B 21/0552 482/142
7,326,159 B2 * 2/2008 Rong ..... A63B 21/0004 482/140
7,329,213 B1 * 2/2008 Farley ..... A63B 23/0211 482/140
7,563,211 B1 * 7/2009 Wu ..... A63B 21/045 482/123
7,811,215 B2 * 10/2010 Wallach ..... A63B 21/0552 482/121
7,833,143 B1 * 11/2010 Tsai ..... A63B 21/0552 482/140
8,172,732 B1 * 5/2012 Webber ..... A63B 21/0615 482/140
8,241,190 B2 * 8/2012 Van Straaten ..... A63B 23/1209 482/130
8,556,780 B2 * 10/2013 Chen ..... A63B 21/023 482/140
8,641,588 B2 * 2/2014 Verheem ..... A63B 21/0421 482/140
9,480,340 B1 * 11/2016 Harlow ..... A47C 7/543
9,770,622 B2 * 9/2017 Campanaro ..... A63B 21/00065
2002/0103058 A1 * 8/2002 Webber ..... A63B 21/00181 482/104
2004/0053757 A1 * 3/2004 Chung ..... A63B 23/03525 482/140
2005/0032611 A1 * 2/2005 Webber ..... A63B 23/1254 482/72
2005/0075224 A1 * 4/2005 Lin ..... A63B 21/0004 482/130
2005/0075225 A1 * 4/2005 Shin ..... A63B 21/0004 482/130
2005/0181916 A1 * 8/2005 Frost ..... A63B 21/0004 482/140
2016/0107023 A1 * 4/2016 Campanaro ..... A63B 22/0087 482/72

* cited by examiner

MULTI-MODE SQUAT RACK

BACKGROUND OF INVENTION

1. Field of Invention

The present invention relates to a squat rack and, more particularly, to a multi-mode squat rack.

2. Related Prior Art

To squat, a person has to use his or her upper legs, abdomen and lower back. Hence, a person can squat to exercise muscles in his or her torso, waist, abdomen, hips and upper legs. However, a person can exert too much stress in his or her knees or upper legs and hence excessively wear the knees or pull the muscles in the upper legs.

Taiwanese Patent Publication No. 313866 discloses a conventional squat rack for helping a user squat. The conventional squat rack includes a lower tube 1 connected to an upper tube 2, a seat tube 10 pivotally connected to the upper tube 2, a leg tube 20 pivotally connected to the upper tube 2, a handle 30 pivotally connected to the upper tube 2, a connector 4 for connecting the seat tube 10 to the leg tube 20, and a connector 40 for connecting the seat tube 10 to the handle 30. Thus, the leg tube 20 is pivoted together with the handle 30. Hence, the user's hands, torso and legs move together with the conventional squat rack. Hence, the user's muscles in the waist and upper legs are only subject to light loads. That is, the user does not exercise the waist and upper legs sufficiently. The conventional squat rack is not effective in helping the user to exercise the waist and upper legs.

Therefore, the present invention is intended to obviate or at least alleviate the problems encountered in prior art.

SUMMARY OF INVENTION

It is an objective of the present invention to provide a multi-mode squat rack that is adjustable to fit various sizes of users.

It is another objective of the present invention to provide a multi-mode squat rack that is adjustable to satisfy various intensities of exercise.

It is another objective of the present invention to provide a multi-mode squat rack to help a user keep a correct pose in exercise.

To achieve the foregoing objectives, the multi-mode squat rack includes a frame unit, a support unit and a handle unit. The frame unit includes a first strut, a second strut pivotally connected to the first strut, two stepping boards connected to one of the first and second struts, and a mount pivotally connected to the first strut. The mount can be kept in position on the first strut. The support unit includes a seat post pivotally connected to the first strut, a seat supported on the seat post, a pair of ears supported on a side of the seat post near the first strut, at least one fin supported on an opposite side of the seat post, and an elastic unit arranged between the mount and the fin. The handle unit includes a stem pivotally connected to the first strut, a connection rod formed with an end pivotally connected to the stem and another end pivotally connected to the first strut or the pair of ears, and a handle connected to the stem.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF EMBODIMENTS

Referring to FIGS. 1 to 14, a multi-mode squat rack includes a frame unit 10, a support unit 20 pivotally connected to the frame unit 10 and a handle unit 30 pivotally connected to the frame unit 10 according to a first embodiment of the present invention.

Figure 1:
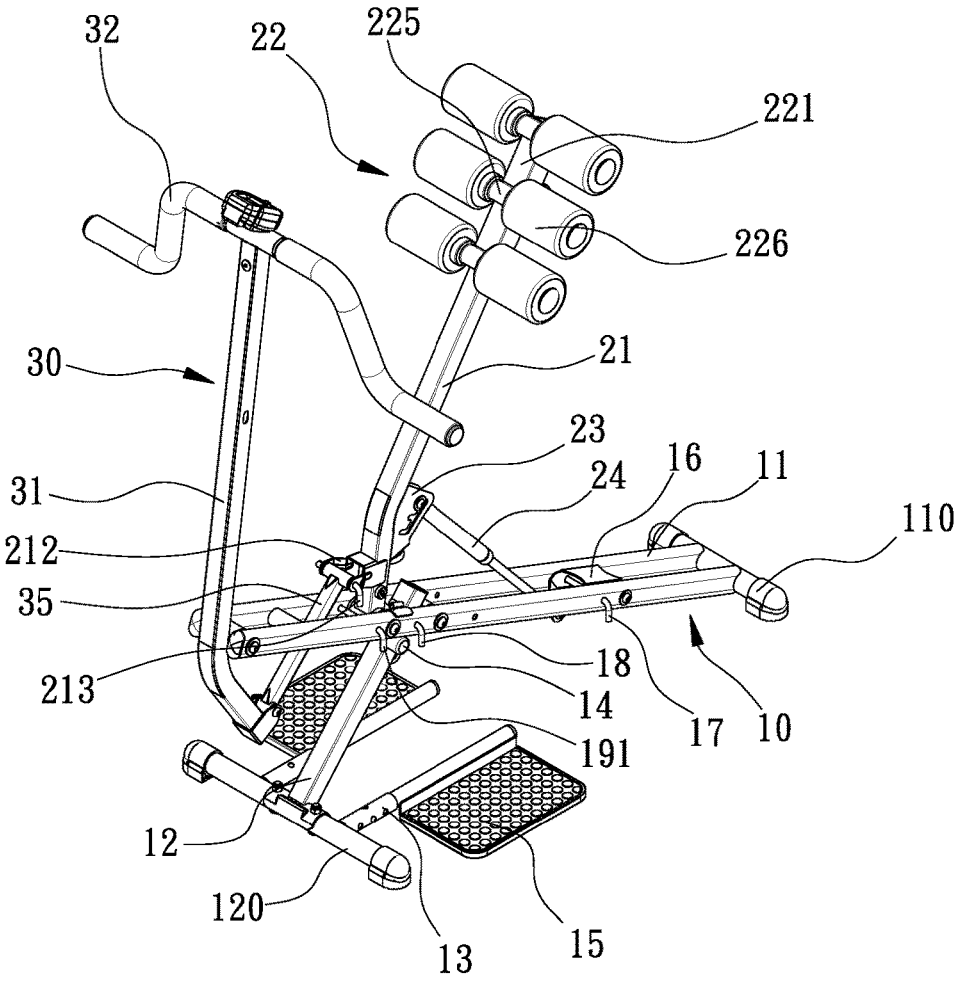
FIG. 1 is a perspective view of a multi-mode squat rack according to the first embodiment of the present invention.
Figure 2:
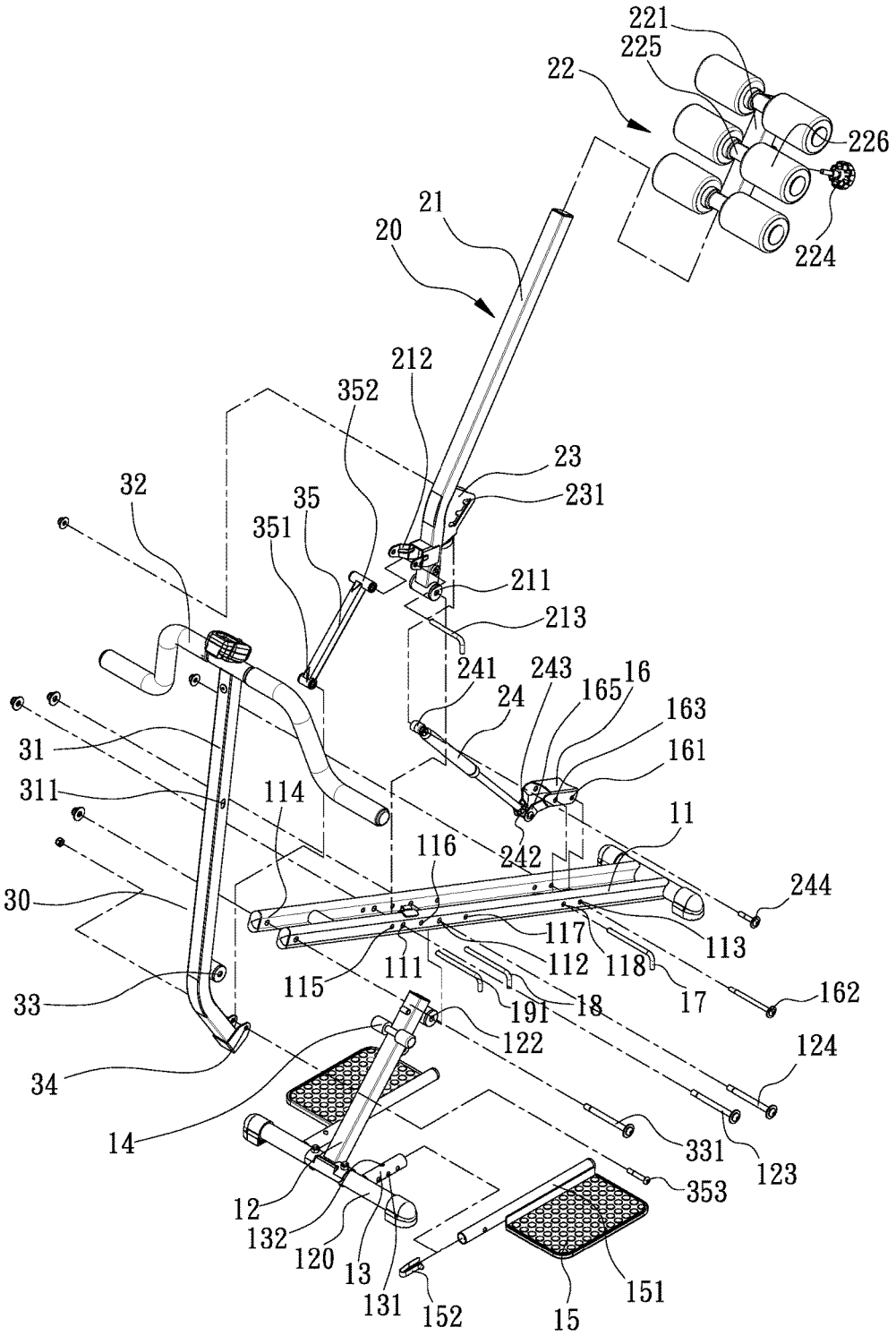
FIG. 2 is an exploded side cross-sectional view of the multi-mode squat rack shown in FIG. 1.
Figure 3:
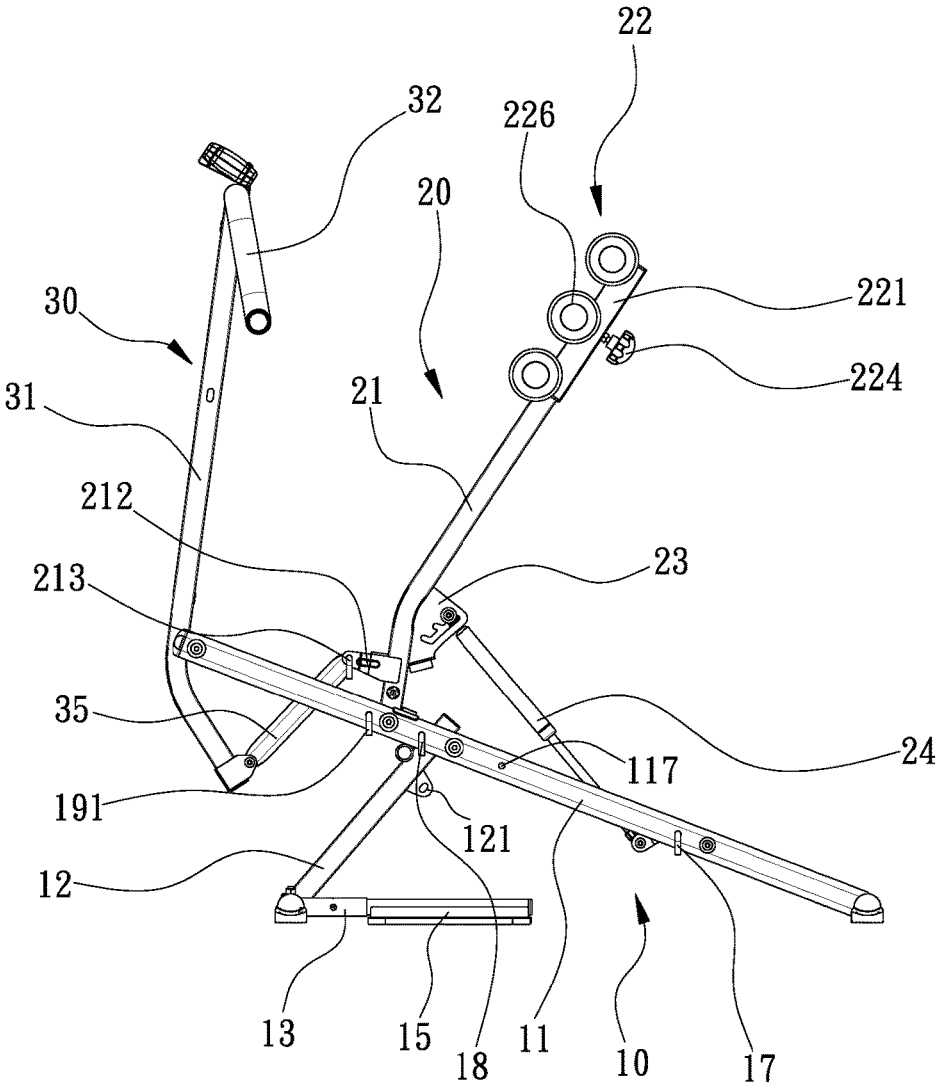
FIG. 3 is a side view of the multi-mode squat rack shown in FIG. 1.

Referring to FIGS. 2 and 3, the frame unit 10 includes two struts 11 and 12. The strut 11 includes a foot tube 110 at a lower end and two longitudinal tubes (not numbered) connected to the foot tube 110 in perpendicular. Each of the longitudinal tubes includes apertures 114, 115, 111, 116, 112, 117 118 and 113 arranged in order from a front end to a rear end.

The strut 12 includes a foot tube 120 at a lower end, at least one ear 121 (FIG. 3) on a rear side, a lug 122 near an upper end, two longitudinal stepping board-connecting tubes 13 connected to the foot tube 120, and a crossbar 14 on a front side. A pivot 124 is inserted in the lug 122 and the aperture 112 to pivotally connect the strut 12 to the strut 11. Each of the stepping board-connecting tubes 13 includes several positioning apertures 131 in a lateral side and a locking aperture 132 in an upper face.

There are two stepping boards 15 each including an axle 151 and a spring-loaded detent 152 connected to the axle 151. Each of the axles 151 is inserted in one of the stepping board-connecting tubes 13 to movably connect the stepping boards 15 to the foot tube 120. Each of the spring-loaded detents 152 can be inserted in a selected one of the positioning apertures 131 of the corresponding stepping board-connecting tube 13 when the multi-mode squat rack is in an extended position where the stepping boards 15 are laid on a floor.

A mount 16 includes two apertures 161 and 163 and a pair of ears 165. A pivot 162 is inserted in the aperture 161 and the aperture 113 to pivotally connect the mount 16 to the strut 11. A pin 17 can be inserted in the positioning aperture 163 to keep the mount 16 in position relative to the strut 11. The pin 17 can be removed from the positioning aperture 163 to allow the mount 16 to pivot relative to the strut 11. The pair of ears 165 is used for pivotal connection to the support unit 20.

The support unit 20 includes a seat post 21 and a seat 22. The seat post 21 includes a lug 211 at a lower end and a pair of ears 212 near the lug 211. A pivot 123 is inserted in the lug 211 and the aperture 111 to pivotally connect the seat post 21 to the strut 11.

The seat 22 includes a sleeve 221, several crossbars 25 connected to the sleeve 221, and several tubular cushions 226 supported on the crossbars 25. The sleeve 221 is supported on the seat post 21 in a translational manner. A threaded bolt 224 is inserted in a screw hole in the sleeve 221. An end of the threaded bolt 224 can be abutted against the seat post 21 to keep the seat 22 in position relative to the seat post 21. A knob (not numbered) is preferably connected to another end of the threaded bolt 224 to facilitate the rotation of the threaded bolt 224.

The support unit 20 further includes two fins 23 attached to a rear side of the seat post 21. Each of the fins 23 includes several adjustment recesses 231 in communication with each other by a slot (not numbered). An elastic unit 24 is arranged between the fins 23 and the mount 16. The elastic unit 24 can be a hydraulic or pneumatic cylinder unit including two lugs 241 and 242 at two ends. A pivot 243 is inserted in the lug 241 and the fins 23 to pivotally connect the elastic unit 24 to the seat post 21. The pivot 243 can be located in a selected one of the positioning recesses 231 of each fin 23 to adjust the damping effect. A pivot 244 is inserted in the lug 242 and the pair of ears 165 to pivotally connect the elastic unit 24 to the mount 16.

The handle unit 30 includes a stem 31, a handle 32, a lug 33, a pair of ears 34 and a connection rod 35. The stem 31 includes an aperture 311 near an upper end. The handle 32 is connected to the upper end of the stem 31.

The lug 33 is attached to a middle section of the stem 3. A pivot 331 is inserted in the lug 33 and the aperture 114 to pivotally connect the stem 31 to the strut 11.

The pair of ears 34 is attached to a lower end of the stem 31. The connection rod 35 includes two lugs 351 and 352 at two ends. A pivot 353 is inserted in the pair of ears 34 and the lug 351 to pivotally connect the stem 31 to the connection rod 35.

Figure 4:
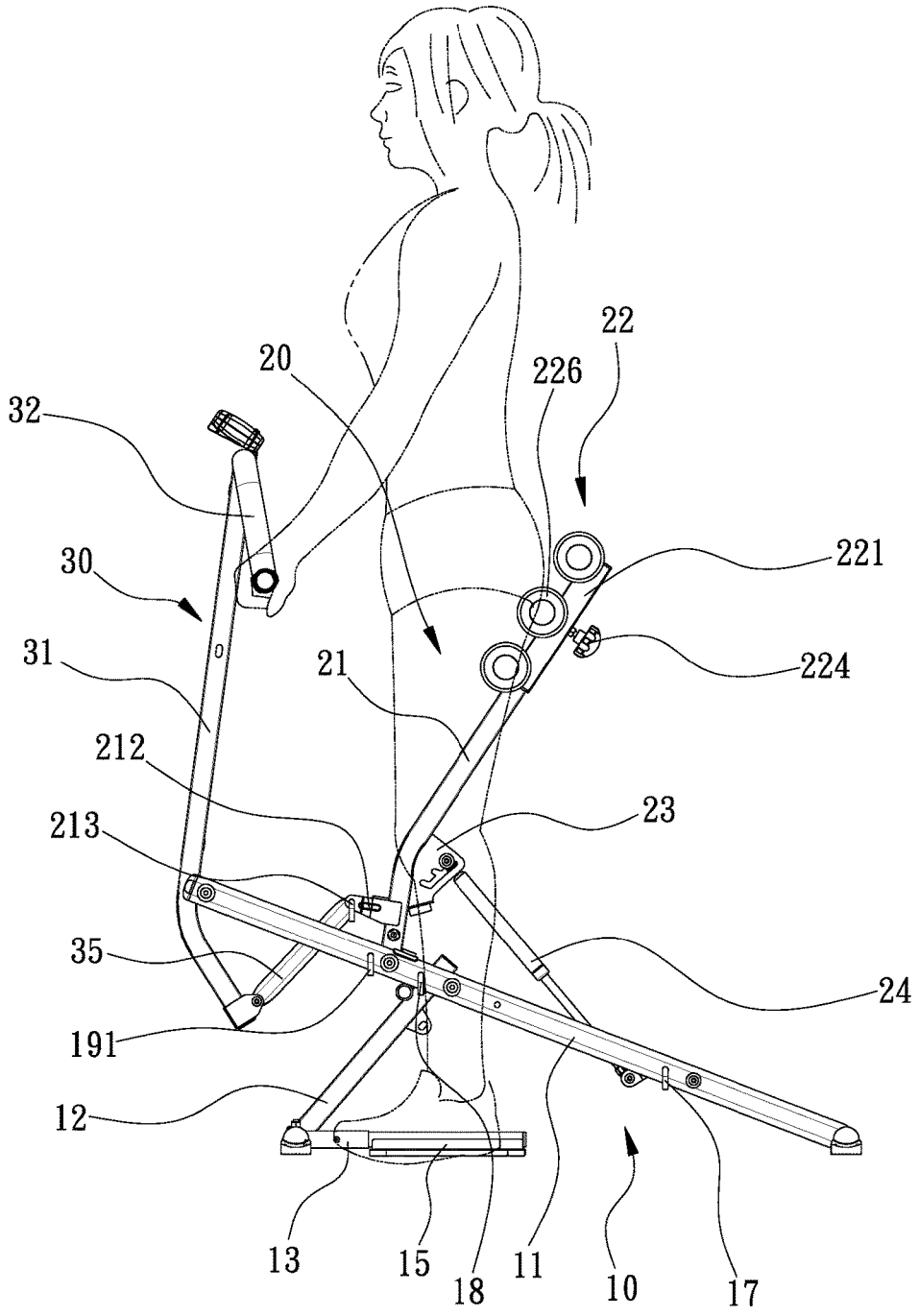
FIG. 4 is a side view of a user using the multi-mode squat rack shown in FIG. 3.
Figure 5:
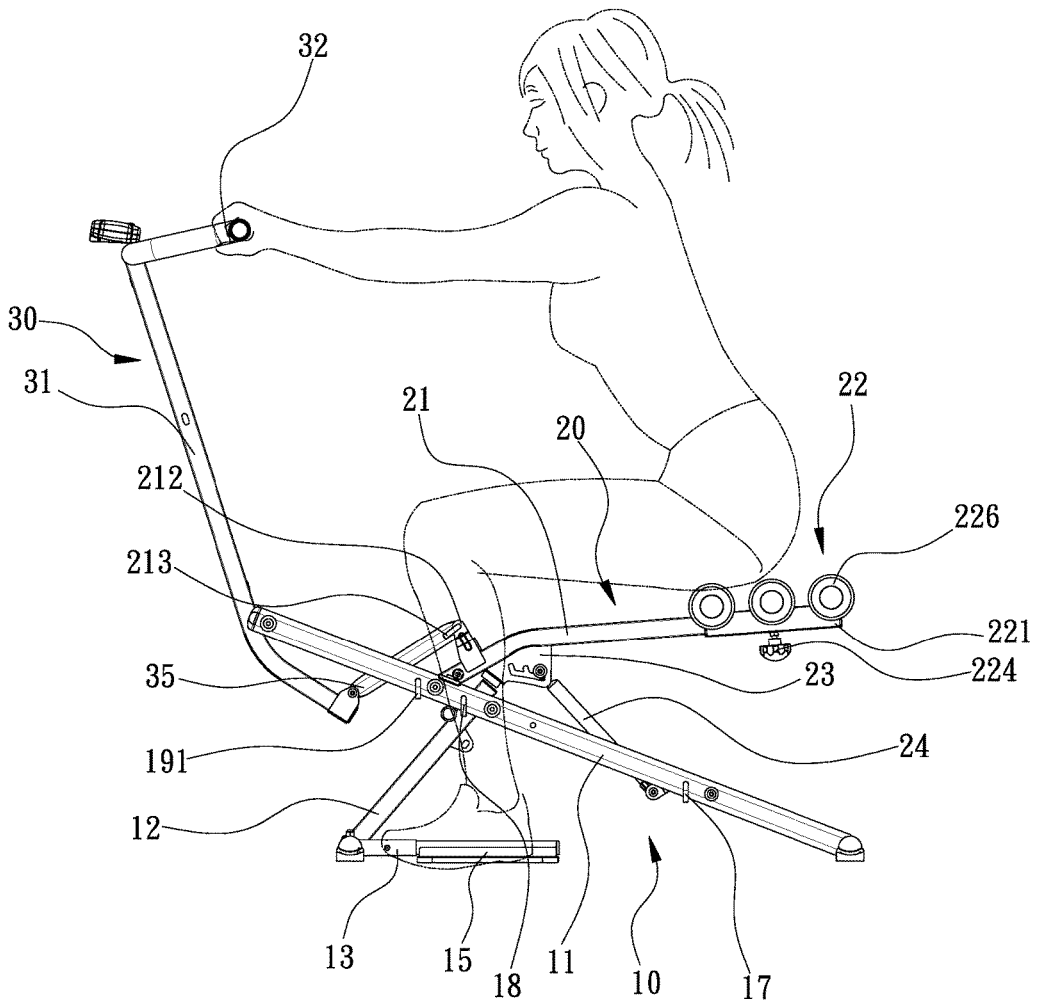
FIG. 5 is a side view of the user and the multi-mode squat rack in another position than shown in FIG. 4.

Referring to FIGS. 3 through 5, the multi-mode squat rack is in a first mode. A pin 213 is inserted in the lug 352 and the pair of ears 212 to pivotally connect the stem 31 to the seat post 21, thereby allowing the handle unit 30 to move the support unit 20. The pin 17 is inserted in the aperture 165 of the mount 16 and the aperture 118 of the strut 11 to prevent the mount 16 from pivoting relative to the strut 11. A pin 18 is inserted in the aperture 116 made in the first strut 11 to limit the strut 12 from the back. The crossbar 14 abuts the strut 11 to limit the strut 12 from the front. Thus, the strut 12 is kept in an extended position relative to the strut 11 by the pin 18 and the crossbar 14.

Referring to FIG. 4, a user stands before the support unit 20, treading on the stepping boards 15, and holding the handle 32. The elastic unit 24 presses the seat 22 of the support unit 20 against the hips of the user, helping the user stand.

A user can pull the handle 32 toward her body to lift the seat post 21 via the stem 31 and the connection rod 35 since the stem 31 of the handle unit 30 is connected to the seat post 21 of the support unit 20 via the connection rod 35. The elastic unit 24 tends to lift the seat post 21 to lift the user.

Referring to FIG. 5, the user squats. While squatting, the user carries her weight not only by her legs but also her arms, with some help from the elastic unit 24. That is, the user does not have to use her legs to carry 100% of her weight. Hence, the user can squat for a long period of time, with a good effect of exercise. The user can use her arms in addition to her legs to stand up, with the help from the elastic unit 24.

Figure 6:
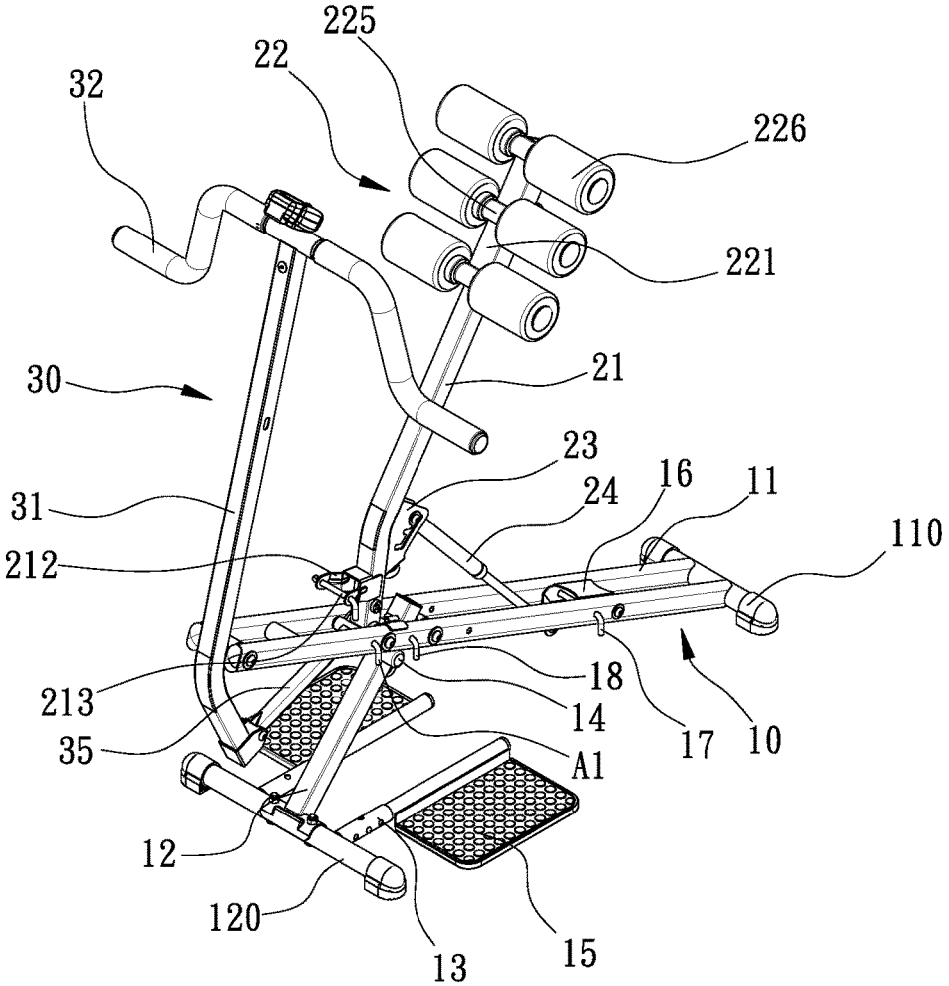
FIG. 6 is a perspective view of the multi-mode squat rack in another mode than shown in FIG. 1.
Figure 7:
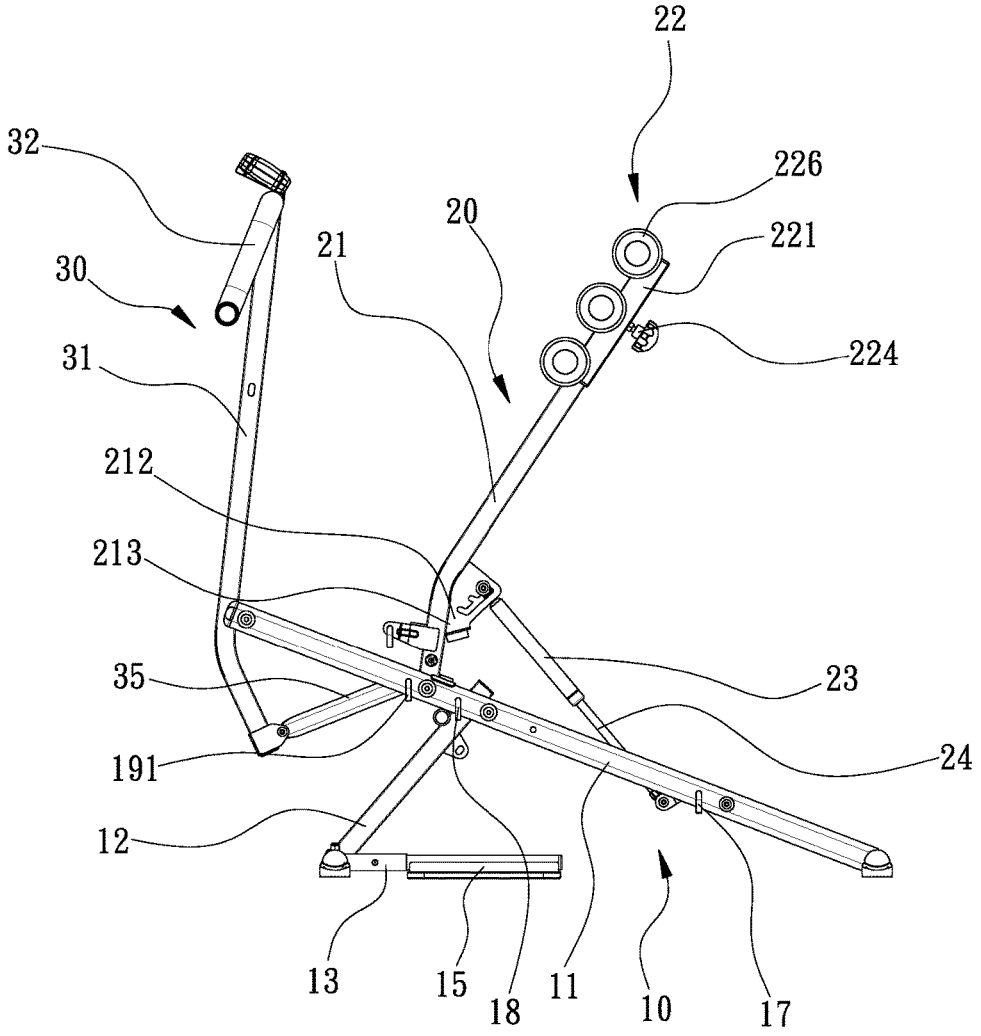
FIG. 7 is a side view of the multi-mode squat rack shown in FIG. 6.
Figure 8:
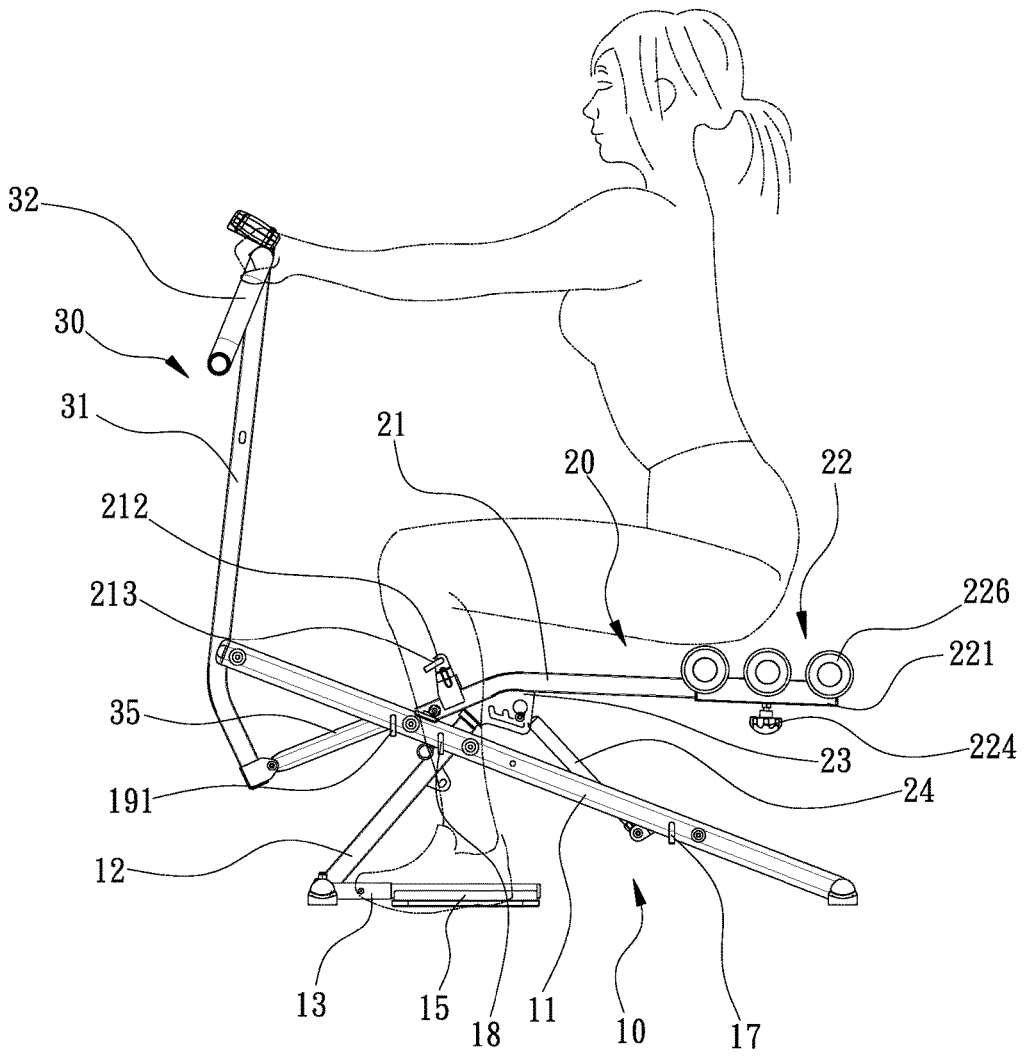
FIG. 8 is a side view of the multi-mode squat rack in another position than shown in FIG. 7.
Figure 9:
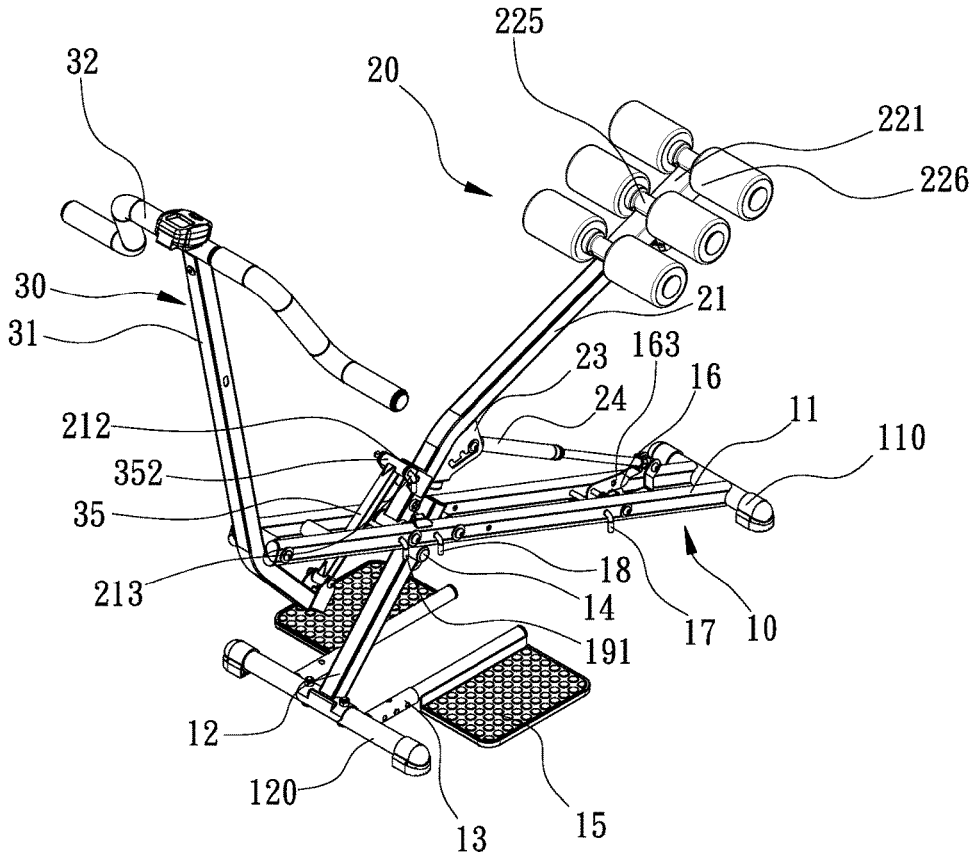
FIG. 9 is a perspective view of the multi-mode squat rack in another mode than shown in FIG. 6.
Figure 10:
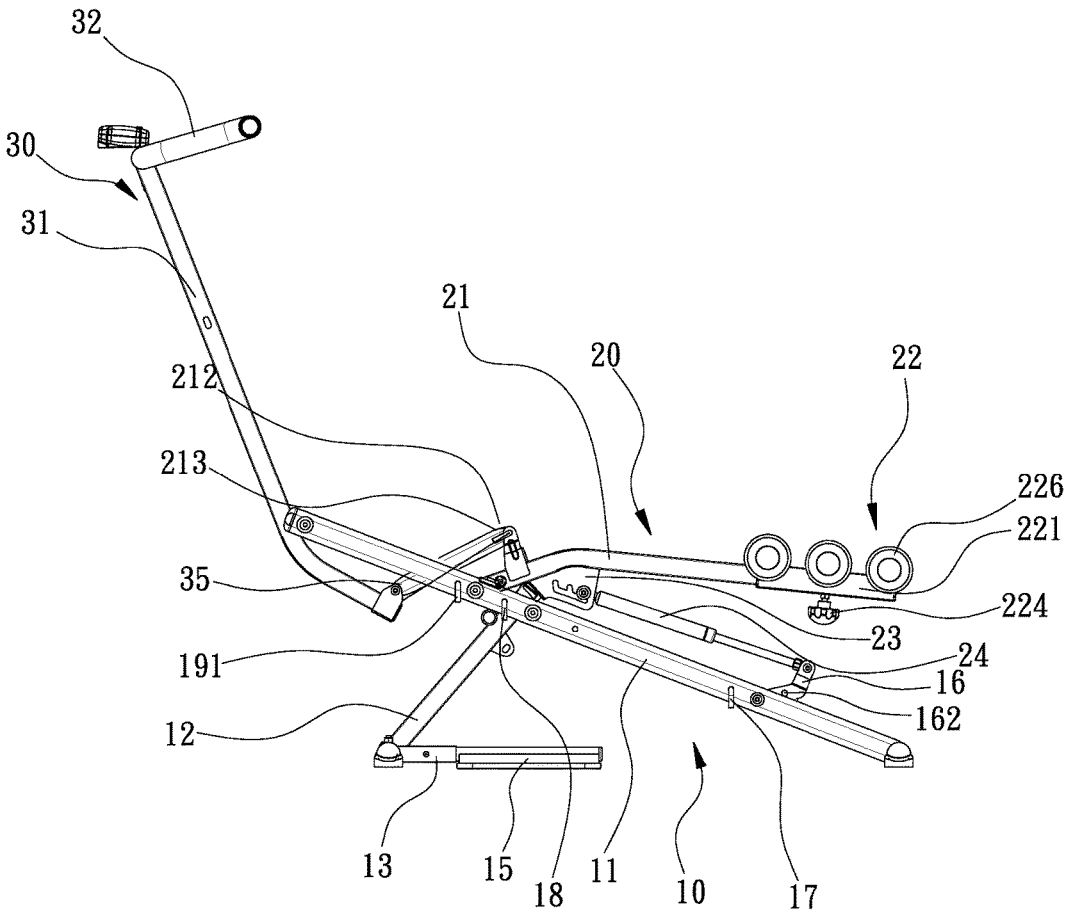
FIG. 10 is a side view of the multi-mode squat rack shown in FIG. 9.

Referring to FIGS. 6 through 8, the multi-mode squat rack is in a second mode. The second mode is different from the first mode by two things. Firstly, instead of the pin 213, a pin 191 is inserted in the lug 351 of the connection rod 35 and the aperture 115 of the strut 11 to prevent the handle unit 30 from movement on the strut 11. Secondly, the pin 17 is removed from the aperture 165 to allow the mount 16 to pivot relative to the strut 11.

The user can stand before the support unit 20, treading on the stepping boards 15, and holding the handle 32. The elastic unit 24 presses the seat 22 of the support unit 20 against the hips of the user, helping the user stand. The user can pull herself toward the handle 32 of the handle unit 30, thereby directly lifting herself. The elastic unit 24 tends to lift the seat post 21 to lift the user.

While squatting, the user carries her weight only by her legs but also her arms, with some help from the elastic unit 24. That is, the user does not have to use her legs to carry 100% of her weight. Hence, the user can squat for a long period of time, with a good effect of exercise. The user can use her arms in addition to her legs to stand up, with the help from the elastic unit 24.

Referring to FIGS. 9 to 12, the multi-mode squat rack is in a third mode. The third mode is different from the first mode by one thing, i.e., the pin 17 is removed from the aperture 165 to allow the mount 16 to pivot relative to the strut 11. The mount 16 is pivoted for about 180° from the position shown in FIGS. 4 and 5. Now, the support unit 20 is located horizontally, and the seat post 21 is not supported by the elastic unit 24.

Figure 11:
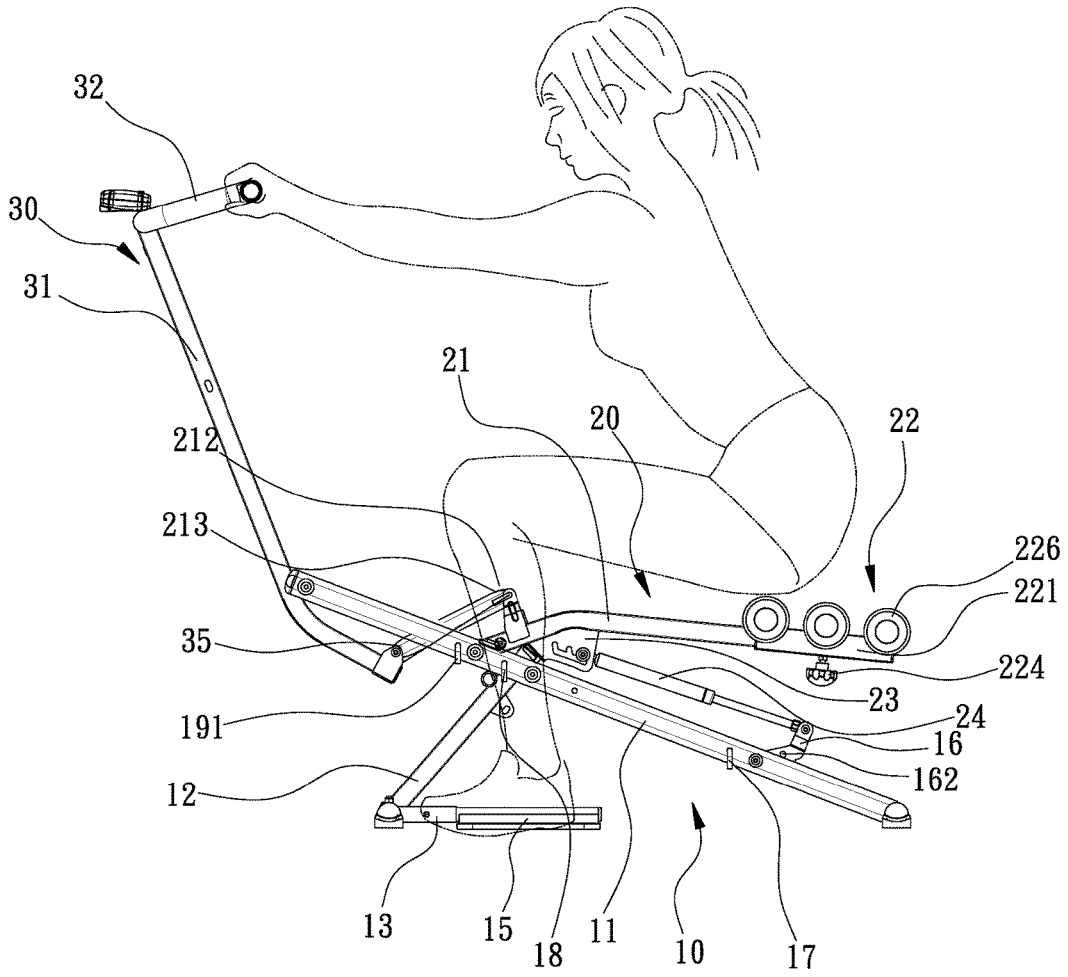
FIG. 11 is a side view of a user using the multi-mode squat rack shown in FIG. 10.

Referring to FIG. 11, the user squats, sitting on the support unit 20, treading on the stepping boards 15, and holding the handle 32. In the horizontal position, the support unit 20 allows the user to squat to a low position to hence exert a heavy load on her legs.

Figure 12:
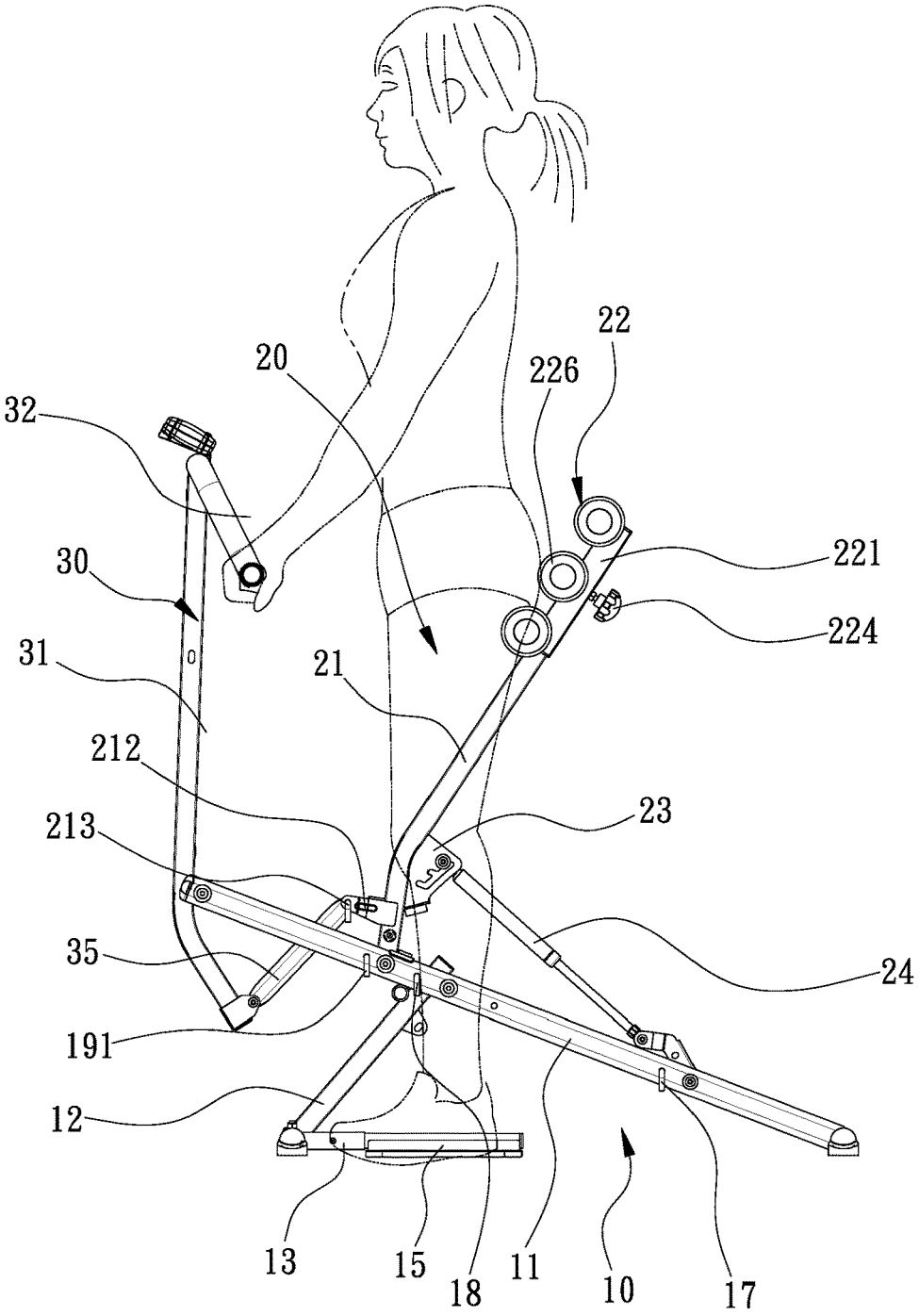
FIG. 12 is a side view of the user and the multi-mode squat rack in another position than shown in FIG. 11.

Referring to FIG. 12, the user stands up. In this process, the user pulls the handle 32 toward her body to lift the seat post 21 via the stem 31 and the connection rod 35 since the stem 31 of the handle unit 30 is connected to the seat post 21 of the support unit 20 via the connection rod 35. The elastic unit 24 tends to lift the seat post 21 to lift the user.

Figure 14:
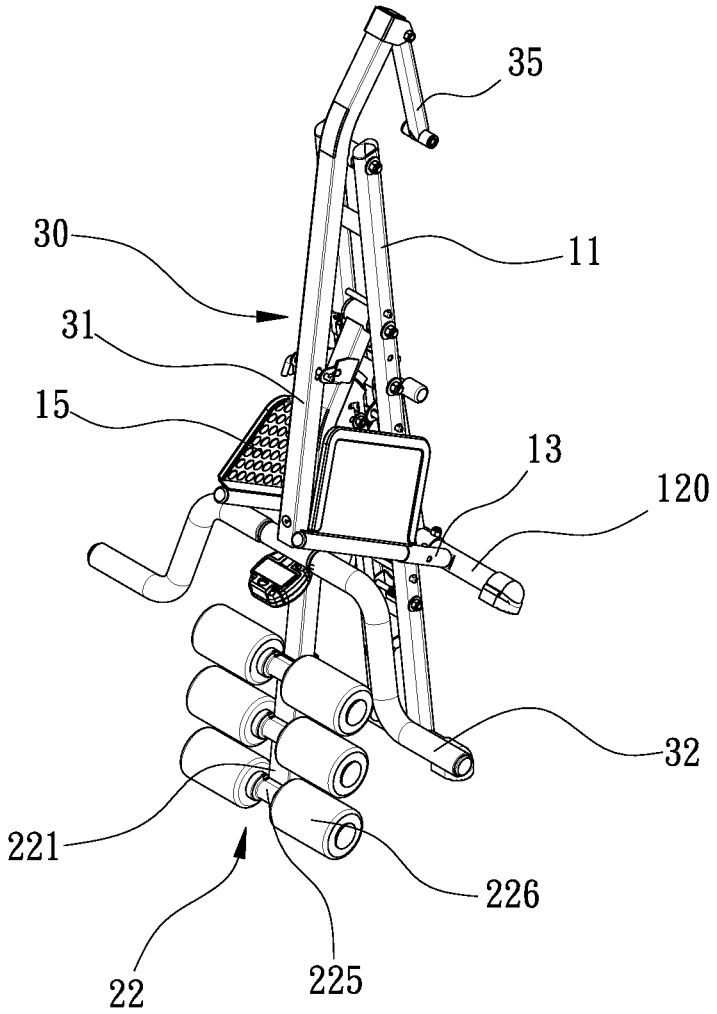
FIG. 14 is a perspective view of the multi-mode squat rack in a collapsed position other than the extended position shown in FIG. 1.

Referring to FIG. 14, the multi-mode squat rack is in a collapsed position. Each of the spring-loaded detents 152 is inserted in the locking aperture 132 of the corresponding stepping board-connecting tube 13 when the multi-mode squat rack is in the collapsed position. The pin 18 is inserted in the ear 121 and the aperture 117 to keep the strut 12 in a collapsed position relative to the strut 11. The pin 213 is inserted in the aperture 311 and the pair of ears 212 to keep the stem 31 close to the seat post 21. Now, the multi-mode squat rack occupies a small space to facilitate storage and transportation thereof.

Figure 13:
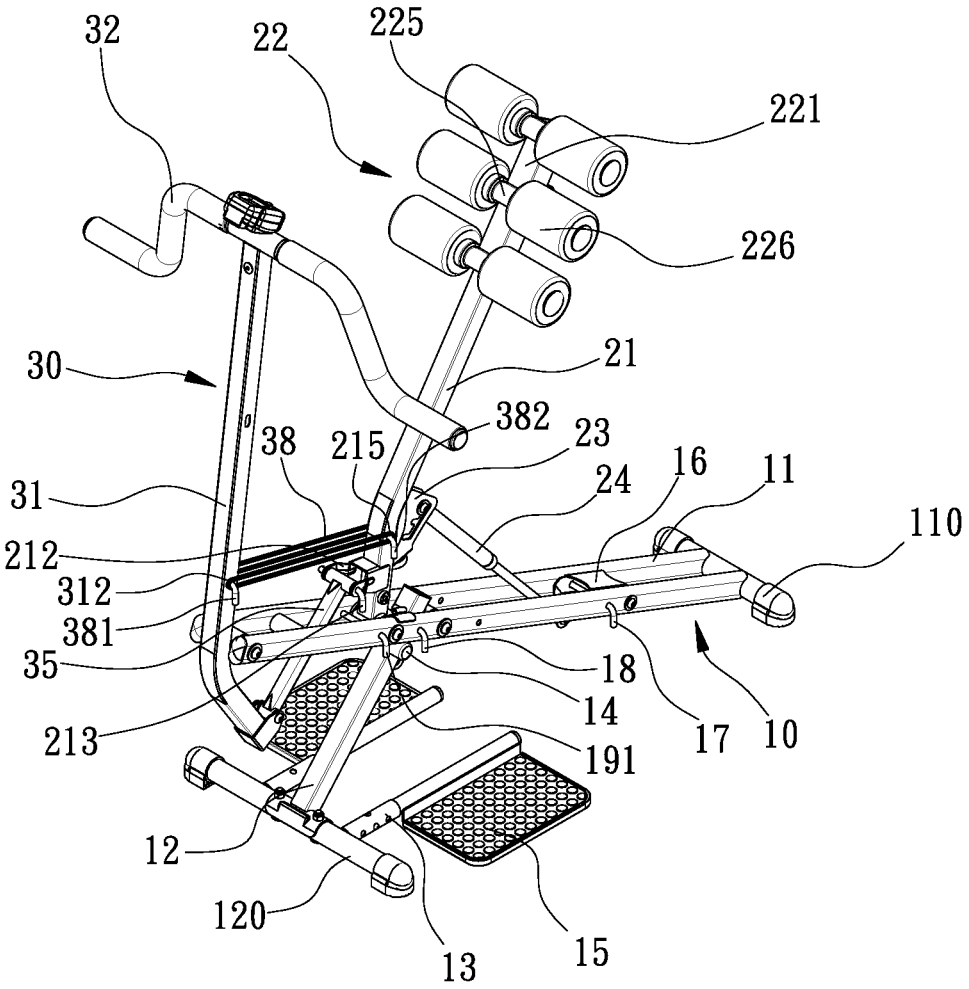
FIG. 13 is a perspective view of a multi-mode squat rack according to the second embodiment of the present invention.

Referring to FIG. 13, there is a multi-mode squat rack according to a second embodiment of the present invention. The second embodiment is identical to the first embodiment except for including two rubber bands 38 instead of the elastic unit 24. The seat post 21 includes an aperture 215. The stem 31 includes an aperture 312. A pin 381 is inserted in the aperture 312. A pin 382 is inserted in the aperture 215. Each of the rubber bands 38 is supported on the pins 381 and 382. Thus, the rubber bands 38 tend to pull the seat post 21 toward the stem 31.

Figure 15:
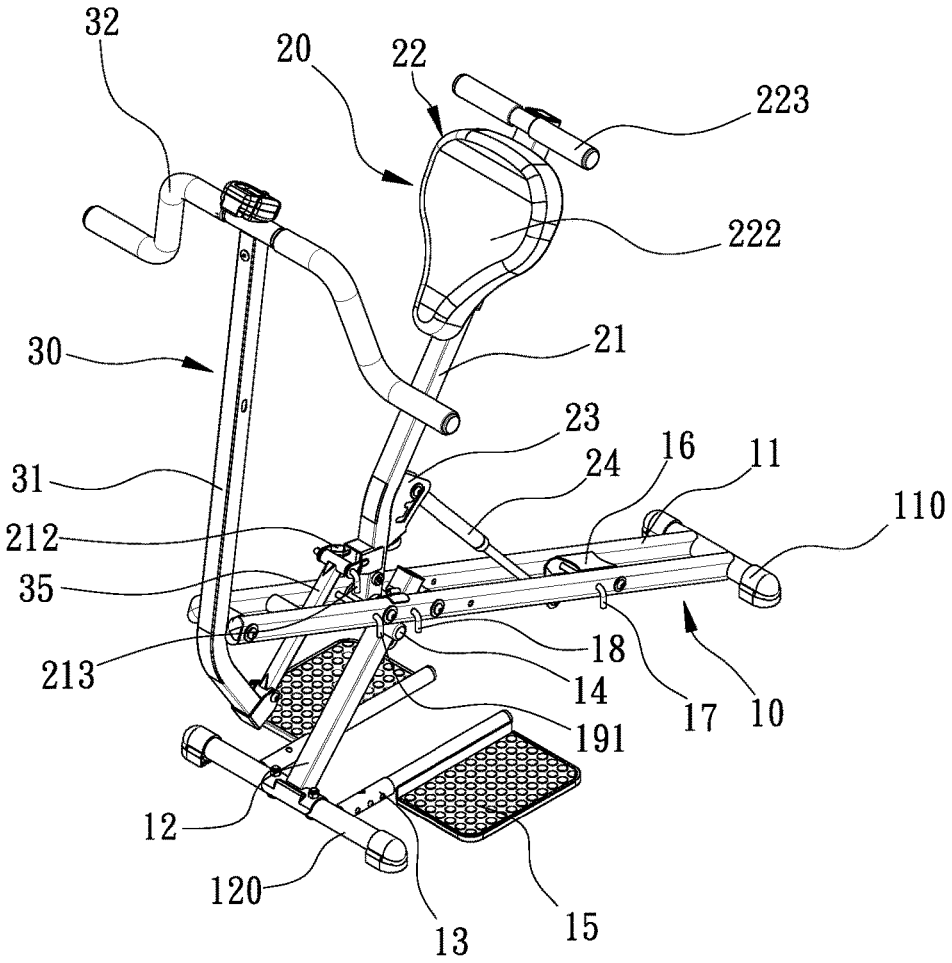
FIG. 15 is a perspective view of a multi-mode squat rack according to the third embodiment of the present invention.

Referring to FIG. 15, there is a multi-mode squat rack according to a third embodiment of the present invention. The third embodiment is identical to the first embodiment except for two things. Firstly, the seat 22 includes a saddle 222 instead of the crossbars 225 and the tubular cushions 226. Secondly, the seat 22 further includes an auxiliary handle 223 connected to the sleeve 221 and located higher than the saddle 222. The user can lean on the saddle 222 and hold the auxiliary handle 223 while exercising with the multi-mode squat rack.

Figure 16:
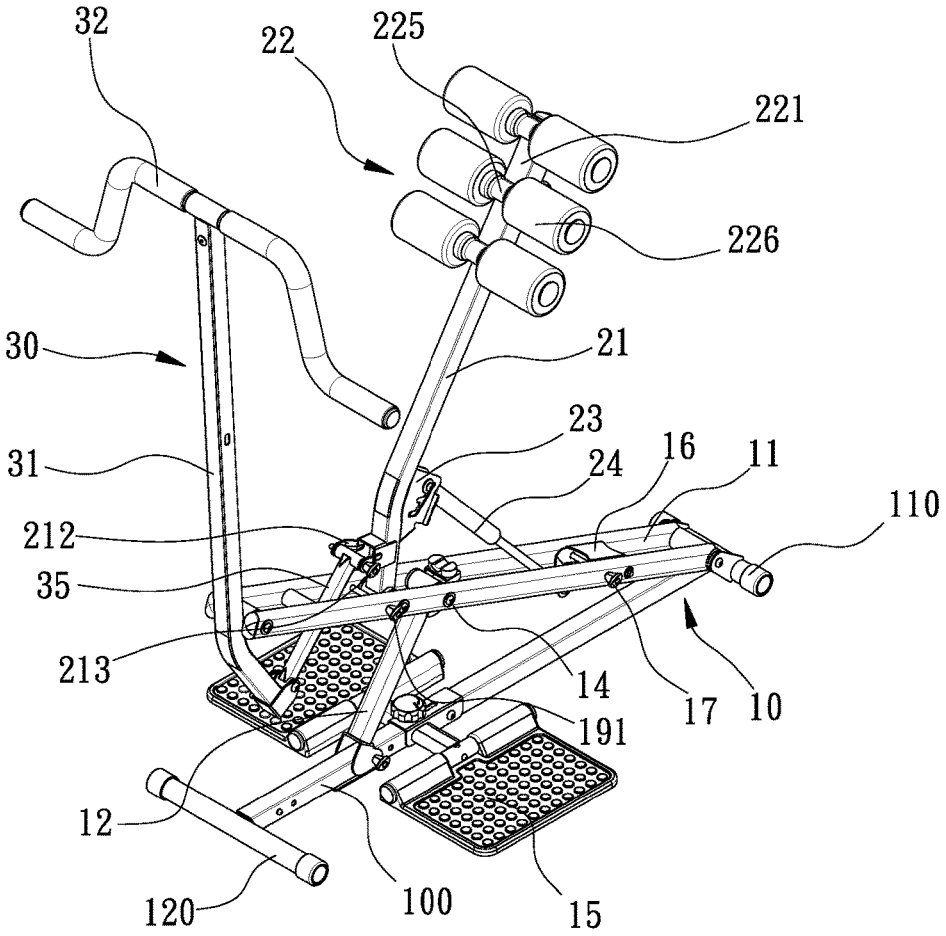
FIG. 16 is a perspective view of a multi-mode squat rack according to the fourth embodiment of the present invention.
Figure 17:
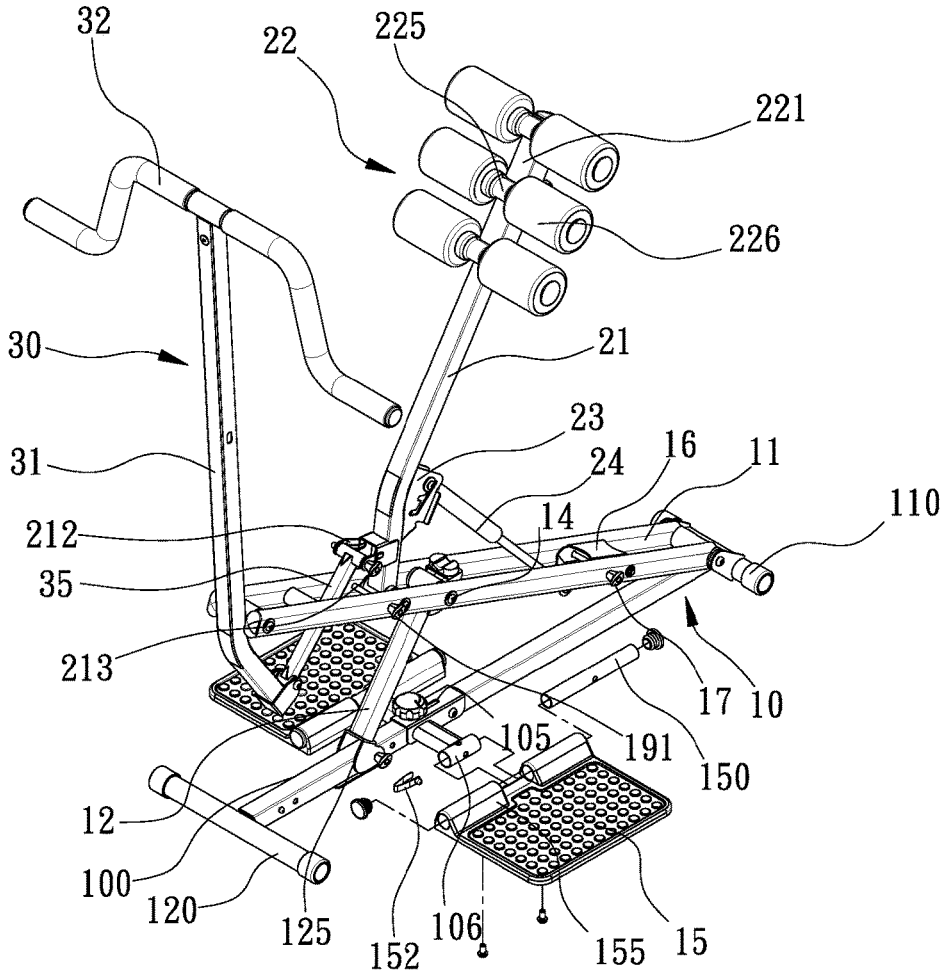
FIG. 17 is an exploded side cross-sectional view of the multi-mode squat rack shown in FIG. 16.

Referring to FIGS. 16 and 17, there is a multi-mode squat rack according to a fourth embodiment of the present invention. The fourth embodiment is identical to the first embodiment except for three things. Firstly, there is a base 100 in the form of a rod or tube. The foot tube 110 is transversely connected to a rear end of the base 100 while the foot tube 120 is transversely connected to a front end of the base 100. The base 100 is pivotally connected to a lower, rear end of the strut 11. The strut 12 includes a collar 125 formed at a lower, front end. The collar 125 is movably supported on the base 100. A pivot (not numbered) can be inserted in the collar 125 and a selected one of several apertures (not numbered) made in the base 100 to keep the collar 125 in a selected one of several positions on the base 100. Secondly, there is a sleeve 105 formed with two lugs 106 on two opposite sides. Thirdly, each of the stepping boards 15 includes two lugs 155. Each of the lugs 106 is located between the lugs 155 of a corresponding one of the stepping boards 15 before an axle 150 is inserted in the lugs 155 of each of the stepping boards 15 and the corresponding lug 106 to pivotally connect the stepping boards 15 to the sleeve 105. Each of the axles 150 is equipped with a spring-loaded detent 152. Each of the lugs 106 includes a first aperture like the positioning apertures 131 and a second aperture like the locking aperture 132. Each of the spring-loaded detent 152 can be inserted in the first aperture of the corresponding lug 106 to keep the corresponding stepping board 15 in an extended position or the second aperture of the corresponding lug 106 to keep the corresponding stepping board 15 in a collapsed position.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A multi-mode squat rack comprising:

a frame unit comprising:

a first strut comprising an aperture;

a second strut pivotally connected to the first strut and comprising:

a lug; and a crossbar adapted for abutment against the first strut when the multi-mode squat rack is in an extended position;

a pivot adapted for insertion in the aperture and the lug to pivotally connect the second strut to the first strut; and a mount pivotally connected to the first strut, wherein the mount can be kept in position on the first strut;

a support unit comprising a seat post pivotally connected to the first strut, a seat supported on the seat post, a pair of ears supported on a side of the seat post near the first strut, at least one fin supported on an opposite side of the seat post, and an elastic unit arranged between the mount and the fin; and a handle unit comprising a stem pivotally connected to the first strut, a connection rod formed with a first end pivotally connected to the stem and a second end pivotally connected to a selected one of the first strut and the pair of ears, and a handle connected to the stem.

2. The multi-mode squat rack according to claim 1, wherein the support unit comprises a lug formed on the seat post and a pivot inserted in the lug and an aperture made in the first strut to pivotally connect the seat post to the first strut, wherein the connection rod comprises a lug formed at the second end, wherein the frame unit comprises a pin adapted for insertion in the lug of the connection rod and another aperture made in the first strut when the connection rod is connected to the seat post.

3. The multi-mode squat rack according to claim 1, wherein the frame unit comprises a pin adapted for insertion in another aperture made in the first strut to limit the second strut when the multi-mode squat rack is in the extended position.

4. The multi-mode squat rack according to claim 1, wherein the frame unit comprises a pin adapted for insertion in an aperture made in the mount and an aperture made in the first strut to keep the mount in position relative to the first strut.

5. The multi-mode squat rack according to claim 1, wherein the fin comprises several adjustment recesses in communication with one another, wherein the elastic unit comprises a lug formed at an end, wherein the support unit comprises a pivot inserted in the lug and a selected one of the adjustment recesses.

6. The multi-mode squat rack according to claim 1, wherein the mount comprises a pair of ears formed at an end, wherein the elastic unit comprises a lug, wherein the support unit comprises a pivot inserted in the lug and the pair of ears of the mount.

7. A multi-mode squat rack comprising:

a frame unit comprising a first strut, a second strut pivotally connected to the first strut, a foot tube transversely connected to the second strut, at least one stepping board connected to the foot tube, and a mount pivotally connected to the first strut, wherein the mount can be kept in position on the first strut;

a support unit comprising a seat post pivotally connected to the first strut, a seat supported on the seat post, a pair of ears supported on a side of the seat post near the first strut, at least one fin supported on an opposite side of the seat post, and an elastic unit arranged between the mount and the fin; and a handle unit comprising a stem pivotally connected to the first strut, a connection rod formed with a first end pivotally connected to the stem and a second end pivotally connected to a selected one of the first strut and the pair of ears, and a handle connected to the stem;

wherein the second strut comprises at least one stepping board-connecting tube transversely connected to the foot tube, wherein the stepping board comprises an axle inserted in the stepping board-connecting tube to movably connect the stepping board to the foot tube.

8. The multi-mode squat rack according to claim 7, wherein the stepping board-connecting tube comprises several positioning apertures in a side and a locking aperture in an upper face, wherein the stepping board includes a spring-loaded detent connected to the axle, wherein the spring-loaded detent is inserted in a selected one of the positioning apertures to keep the stepping board on a floor, wherein the spring-loaded detent is inserted in the locking aperture to keep the stepping board from the floor.

9. A multi-mode squat rack comprising:

a frame unit comprising a first strut, a second strut pivotally connected to the first strut, and a mount pivotally connected to the first strut, wherein the mount can be kept in position on the first strut;

a support unit comprising a seat post pivotally connected to the first strut, a seat supported on the seat post, a pair of ears supported on a side of the seat post near the first strut, at least one fin supported on an opposite side of the seat post, and an elastic unit arranged between the mount and the fin; and a handle unit comprising a stem pivotally connected to the first strut, a connection rod formed with a first end pivotally connected to the stem and a second end pivotally connected to a selected one of the first strut and the pair of ears, and a handle connected to the stem;

wherein the seat comprises a sleeve supported on the seat post in a translational manner.

10. The multi-mode squat rack according to claim 9, wherein the support unit comprises a threaded bolt adapted for insertion in the sleeve and abutment against the post to keep the sleeve in position relative to the seat post.

11. The multi-mode squat rack according to claim 9, wherein the seat comprises several crossbars connected to the sleeve and tubular cushions supported on the crossbars.

* * * * *